US007959060B2

(12) United States Patent
Wilson et al.

(10) Patent No.: US 7,959,060 B2
(45) Date of Patent: Jun. 14, 2011

(54) MULTI-PLY CARTON HAVING RECLOSABLE OPENING FEATURE

(75) Inventors: Weston R. Wilson, Arvada, CO (US); Robert L. Conatser, Golden, CO (US); Kelly R. Fitzwater, Lakewood, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 797 days.

(21) Appl. No.: 11/689,216

(22) Filed: Mar. 21, 2007

(65) Prior Publication Data

US 2007/0221713 A1 Sep. 27, 2007

Related U.S. Application Data

(60) Provisional application No. 60/784,637, filed on Mar. 21, 2006.

(51) Int. Cl.

| | |
|---|---|
| ***B65D 5/54*** | (2006.01) |
| ***B65D 3/22*** | (2006.01) |
| ***B65D 5/56*** | (2006.01) |
| ***B65D 17/00*** | (2006.01) |

(52) U.S. Cl. ..... 229/101.2; 229/225; 229/164.2; 229/210; 229/122.32; 229/122.33

(58) Field of Classification Search ..... 229/101.2, 229/225, 164.2, 122.32, 122.33, 210, 235
See application file for complete search history.

(56) References Cited

U.S. PATENT DOCUMENTS

| | | | | |
|---|---|---|---|---|
| 1,772,625 | A | | 8/1930 | Caulfield |
| 2,139,021 | A | | 12/1938 | Johnson |
| 2,192,722 | A | | 3/1940 | Vogt |
| 2,345,486 | A | | 3/1944 | Nathan |
| 2,355,665 | A | | 8/1944 | Mabee |
| 2,365,159 | A | | 12/1944 | Walton |
| 2,396,310 | A | * | 3/1946 | Yungblut ..... 229/101.2 |
| 2,437,926 | A | | 3/1948 | Ball |
| 2,973,086 | A | | 2/1961 | Thompson |
| 3,021,002 | A | | 2/1962 | Reynolds |
| 3,033,362 | A | | 5/1962 | Marcalus |
| 3,355,089 | A | | 11/1967 | Champlin |
| 3,363,822 | A | | 1/1968 | Maulini et al. |
| 3,426,955 | A | | 2/1969 | Olson |
| 3,486,682 | A | * | 12/1969 | Whipperman et al. .... 229/101.2 |
| 3,669,345 | A | | 6/1972 | Cole |
| 3,680,766 | A | | 8/1972 | Collura et al. |
| 3,690,544 | A | | 9/1972 | Meyers |
| 3,744,702 | A | * | 7/1973 | Ellison ..... 229/122.32 |
| 3,768,719 | A | | 10/1973 | Johnson |

(Continued)

FOREIGN PATENT DOCUMENTS

| | | |
|---|---|---|
| DE | 29 23 455 A1 | 12/1980 |

(Continued)

*Primary Examiner* — Gary E Elkins
*Assistant Examiner* — Latrice Byrd
(74) *Attorney, Agent, or Firm* — Womble Carlyle Sandridge & Rice, PLLC

(57) ABSTRACT

A carton is formed from an inner blank and an outer blank. The outer blank ply of the carton includes a pivoting, reclosable lid that allows a top end of the carton to be accessed and subsequently closed. A latch feature is included in the carton to allow the lid to be securely closed over the open top of the carton. The inner blank may form a closed and/or sealed liner vessel within the outer blank ply of the carton.

13 Claims, 8 Drawing Sheets

U.S. PATENT DOCUMENTS

| | | | | | |
|---|---|---|---|---|---|
| 4,262,816 | A | | 4/1981 | Margulies | |
| 4,344,537 | A | | 8/1982 | Austin | |
| 4,484,683 | A | | 11/1984 | Werner, Jr. | |
| 4,508,218 | A | | 4/1985 | Focke et al. | |
| 4,512,476 | A | | 4/1985 | Herrington, Jr. | |
| 4,558,785 | A | | 12/1985 | Gordon | |
| 4,572,423 | A | | 2/1986 | Spencer | |
| 4,584,202 | A | | 4/1986 | Roccaforte | |
| 4,645,108 | A | | 2/1987 | Gavin et al. | |
| 4,676,394 | A | | 6/1987 | Hiersteiner | |
| 4,746,019 | A | | 5/1988 | Prater | |
| 4,863,052 | A | | 9/1989 | Lambert | |
| 4,905,898 | A | | 3/1990 | Wade | |
| 5,105,971 | A | * | 4/1992 | Hertenstein et al. | 229/225 |
| 5,265,799 | A | * | 11/1993 | Stone | 229/225 |
| 5,347,865 | A | | 9/1994 | Mulry et al. | |
| 5,356,022 | A | | 10/1994 | Tipps | |
| 5,363,981 | A | * | 11/1994 | Giblin et al. | 229/238 |
| 5,427,267 | A | | 6/1995 | Willman | |
| 5,632,402 | A | | 5/1997 | Walsh et al. | |
| 5,632,404 | A | | 5/1997 | Walsh | |
| 5,746,871 | A | | 5/1998 | Walsh | |
| 5,783,030 | A | | 7/1998 | Walsh | |
| 5,794,811 | A | | 8/1998 | Walsh | |
| 5,794,812 | A | | 8/1998 | Walsh | |
| 5,857,614 | A | | 1/1999 | Walsh | |
| 5,918,799 | A | | 7/1999 | Walsh | |
| 5,960,555 | A | | 10/1999 | Deaton et al. | |
| 5,996,797 | A | | 12/1999 | Flaig | |
| 6,102,277 | A | | 8/2000 | Krapohl, Sr. | |
| 6,352,096 | B1 | | 3/2002 | Walsh | |
| 6,364,202 | B1 | | 4/2002 | Zelley | |
| 6,568,586 | B1 | | 5/2003 | VanEsley | |
| 6,761,269 | B2 | | 7/2004 | Hamming | |
| 6,854,639 | B2 | | 2/2005 | Walsh | |
| 7,025,504 | B2 | | 4/2006 | Olin | |
| 7,407,087 | B2 | | 8/2008 | DeBusk et al. | |
| 2001/0048022 | A1 | | 12/2001 | Zoeckler | |
| 2002/0036153 | A1 | | 3/2002 | Yang | |
| 2002/0055429 | A1 | | 5/2002 | Walsh | |
| 2003/0144121 | A1 | | 7/2003 | Walsh et al. | |
| 2004/0007614 | A1 | | 1/2004 | Saulas | |
| 2004/0226989 | A1 | | 11/2004 | Cook et al. | |
| 2005/0109827 | A1 | | 5/2005 | Martin | |
| 2005/0187087 | A1 | | 8/2005 | Walsh | |
| 2006/0049067 | A1 | | 3/2006 | McDonald | |
| 2006/0243783 | A1 | | 11/2006 | Spivey, Sr. et al. | |
| 2006/0255105 | A1 | | 11/2006 | Sweet | |
| 2006/0255107 | A1 | | 11/2006 | Wright | |
| 2006/0266810 | A1 | * | 11/2006 | Foushee | 229/101.2 |

FOREIGN PATENT DOCUMENTS

| | | | |
|---|---|---|---|
| DE | 81 10 323.9 | | 9/1981 |
| DE | 87 08 078.8 | | 10/1987 |
| DE | 94 13 813 | U1 | 10/1994 |
| EP | 1 457 425 | A1 | 9/2004 |
| FR | 2 699 150 | | 6/1994 |
| FR | 2 755 670 | | 5/1998 |
| GB | 104445 | | 3/1917 |
| GB | 1 242 356 | | 8/1971 |
| GB | 1 489 963 | | 10/1977 |
| GB | 1 584 066 | | 2/1981 |
| GB | 2 363 372 | A | 12/2001 |
| WO | WO 95/28325 | | 10/1995 |
| WO | WO 2006/133041 | A2 | 12/2006 |

* cited by examiner

MULTI-PLY CARTON HAVING RECLOSABLE OPENING FEATURE

PRIORITY APPLICATION

This application claims the benefit of Provisional Application No. 60/784,637, filed Mar. 21, 2006, the entire contents of which are hereby incorporated by reference.

RELATED APPLICATIONS

This application is related to application Ser. No. 11/586,294, filed Oct. 25, 2006, and to application Ser. No. 11/448,620, filed Jun. 7, 2006. This application is also related to application Ser. No. 10/318,437 to Walsh et al., published as Pub. No. 2003/0144121 A1, entitled "Packages, Blanks for Making Packages and Associated Methods and Apparatus," the entire contents of the publication being hereby incorporated herein by reference.

BACKGROUND

Conventional reclosable paperboard cartons are known. Such cartons often include a bag or other vessel held within the interior of the outer paperboard carton to accommodate the carton contents. The bag may be used to store foodstuffs or other dispensable products. Conventional paperboard cartons, however, may be difficult to open and/or close, and may not close reliably. Insufficiently closed bags may allow the carton contents to escape the carton, or may expose the contents to spillage, insect infestation, or other environmental factors.

The bags used in conventional cartons are often made from differing materials than the exterior carton shell, which is often made from paperboard. The bag therefore requires differing materials of construction and manufacturing techniques than the carton. The bag, for example, may require manufacture and processing at a separate facility from the carton shell. Also, the bag does not provide structural rigidity to the carton.

SUMMARY

According to a first embodiment, a carton is formed from a multi-ply blank, which comprises an outer blank adhered to an inner blank. The outer blank forms an outer ply of the carton, and the inner blank forms an inner ply or vessel within the outer ply. A reclosable lid is formed in the outer ply, and is capable of being opened and reclosed separately from the vessel liner.

According to one aspect of the present invention, the outer blank can be constructed from known materials used to form cartons, such as, for example, paperboard. The inner blank ply may also be constructed of such materials, for example, and may additionally be provided with a coating capable of sealing or otherwise protecting the contents of the carton from moisture, infestation, or to render the contents of the carton insulated from the outside atmosphere. The inner blank ply may also be constructed of materials having inherent barrier properties such as, for example, polymer materials, laminates of polymer materials, and laminates of polymer and paper materials. The inner blank ply may therefore serve as a liner conveying barrier properties to the carton, and may also provide structural rigidity to the carton.

According to another aspect of the invention, once opened, the reclosable lid of the outer ply of the carton enables easy reclosure and opening of the carton for dispensing and/or otherwise accessing the carton contents. The lid may pivot, for example, at a hinge line in a second side panel of the carton, so that the top panel of the carton pivots to a point adjacent to a first side panel of the carton. A latch feature in the first side panel may prevent the reclosable lid from inadvertently opening, for example, when the carton is tipped or otherwise upset.

According to yet another aspect of the invention, the inner and outer carton blanks can be formed from material webs that are capable of continuous and simultaneous processing on the same production line. The multi-ply blank used to form the carton is therefore quickly and easily manufactured.

Also according to the present invention, the height of the carton is reduced after opening and closing. The carton contents are thereby stored in a carton that occupies less volume than the original carton.

Other aspects, features, and details of the present invention can be more completely understood by reference to the following detailed description, taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

A first embodiment of the present invention is addressed to a multi-ply carton 400 (illustrated in FIG. 6) having a pivotable, reclosable lid 450 that allows the contents of the carton 400 to be securely retained within the carton. An inner ply or liner of the carton 400 can be provided with, for example, a coating or other barrier properties that protect the carton contents from moisture, encroachment by insects, etc., and from other environmental factors.

A multi-ply blank 8 (illustrated in FIG. 2) used to form the carton 400 may be formed, for example, in a continuous process production line capable of forming multi-ply blanks. U.S. patent application Ser. No. 10/318,437 (Pub. No. 2003/

0144121 A1) to Walsh et al. discloses a continuous process production line suitable for forming such a blank.

Figure 1:
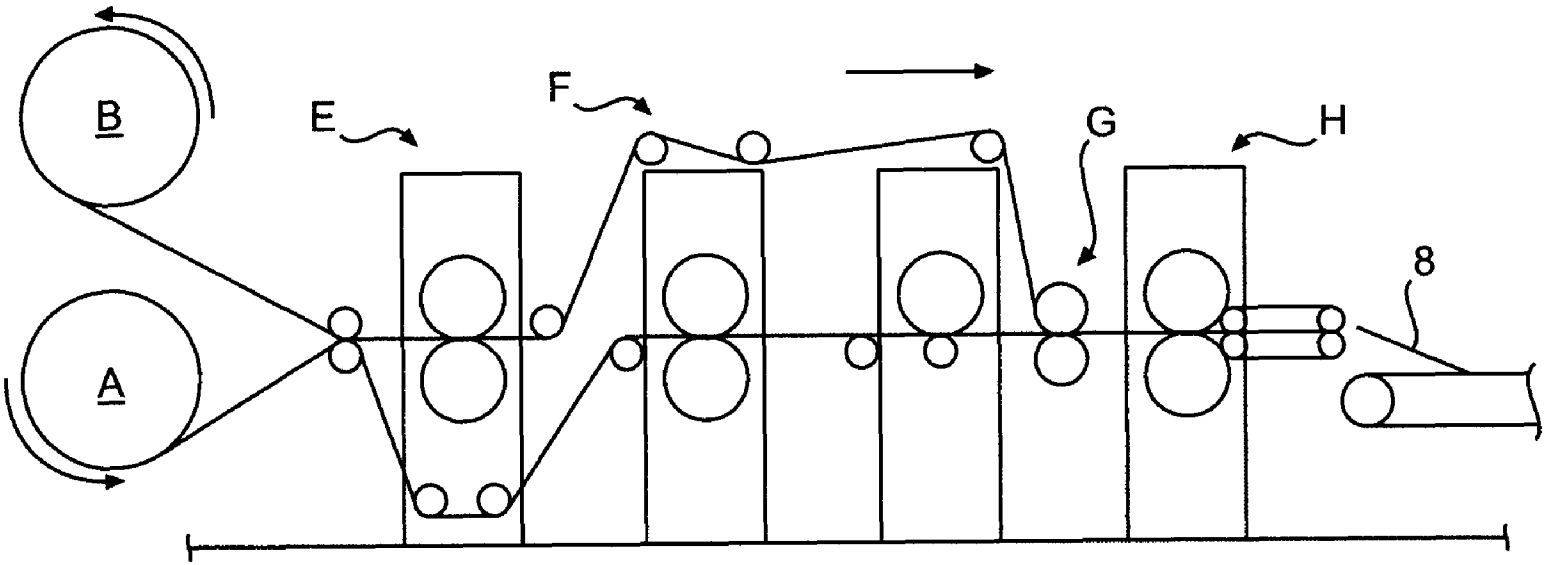
FIG. 1 is a schematic illustration of a continuous production line for producing multi-ply carton blanks.

FIG. 1 is a schematic illustration of a continuous process production line that generally corresponds to FIG. 1 of the Walsh publication, which contents are incorporated by reference herein.

In FIG. 1, a web of material B is provided with a repeating pattern of one or more lines of disruption at a disrupting station E as the web B is unrolled, and a web of material A is provided with a repeating pattern of one or more lines of disruption at a disrupting station F as the web A is unrolled. The webs of material A, B may then be laminated together at a lamination station G, and subsequently passed through a disrupting station H. The laminated webs A, B may then be separated into individual multi-ply carton blanks 8 at the disrupting station H, and also, if desired, provided with additional lines of disruption in the combined webs A, B. The combined webs A, B are generally separated into the individual, multi-ply blanks 8 at locations between the repeating patterns of lines of disruption in the webs A, B. The repeating patterns of disruption in the web A may differ, for example, from the patterns formed in the web B so that the individual plies of the laminate blanks 8 have different properties and/or capabilities.

Figure 2:
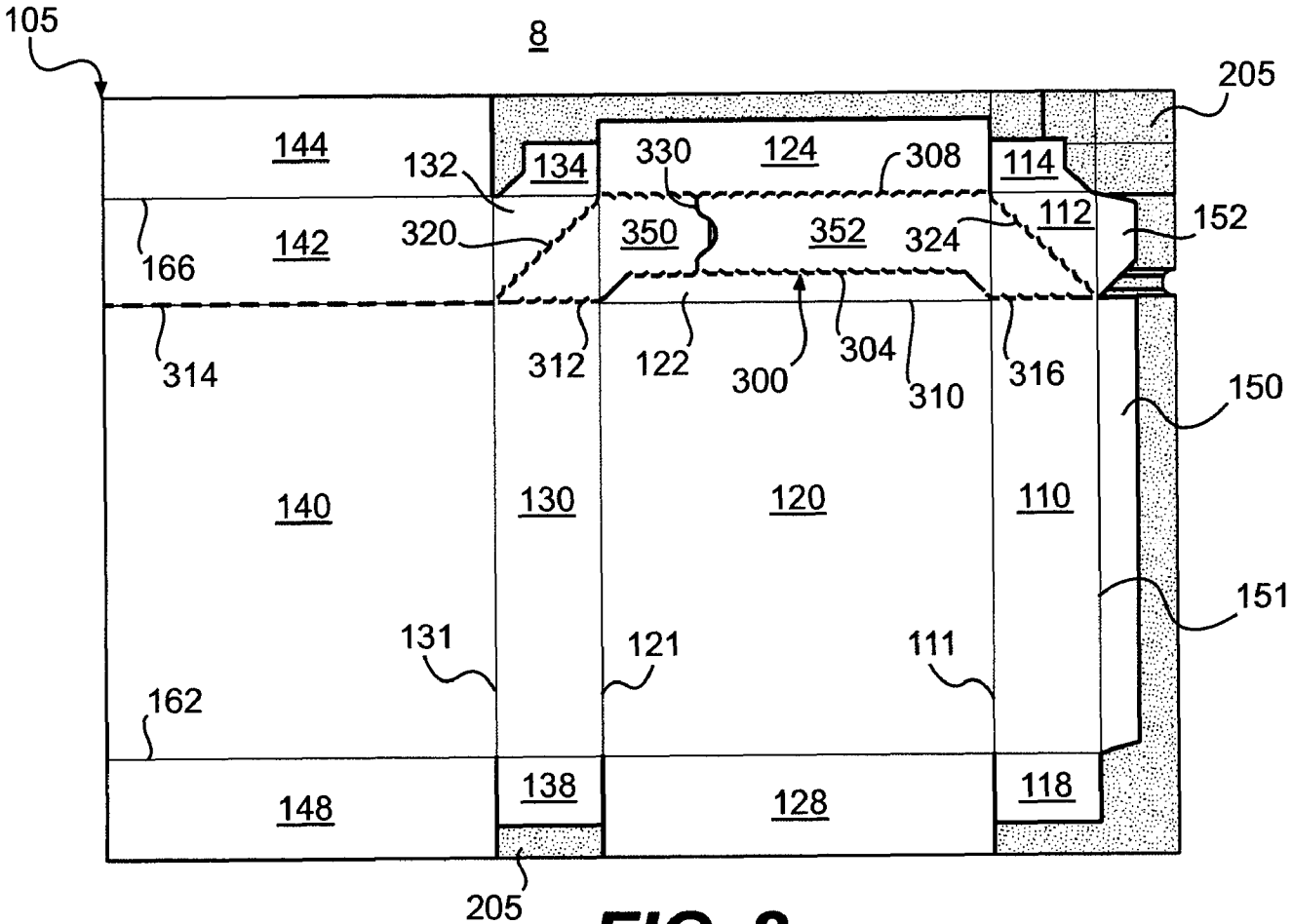
FIG. 2 is a plan view of a multi-ply blank used to form a carton having a reclosable lid according to a first embodiment of the invention.

Referring to FIG. 2, the multi-ply blank 8 used to form the carton 400 is formed from an outer blank 105 and an inner blank 205 adhered, laminated or otherwise joined to the outer blank 105. The outer blank 105 can be formed from, for example, a web of continuously moving web of material such as the web A shown in FIG. 1, and the inner blank 205 can be formed from a continuously moving web of material such as the web B. The terms "outer" and "inner" are used in this specification to indicate the location of the respective blank plies 105, 205 in cartons formed or erected from the finished multi-ply blanks 8.

In FIG. 2, the entire outer or exterior print surface of the outer blank 105 is visible, and the inner blank 205 is joined to the opposite, interior or underside of the outer blank 105. Therefore, only portions of the inner blank 205 are visible in FIG. 2. In the drawing figures of this specification, the surface of the inner blank 205 is shaded with stippling solely to distinguish the inner blank from the outer blank 105, which is not shaded. The inner blank ply 205 is illustrated separately (i.e., in isolation) in FIG. 3. The final multi-ply blank 8 is "multi-ply" in that the joined inner and outer blank plies 205 and 105 comprising the multi-ply blank 8 include substantial overlapping portions. Also, a majority of the overlapping surfaces of the inner and outer blank plies 205, 105 may be adhered to one another. For example, the blanks 105 and 205 have slightly different perimeters or "footprints" and do not overlap at all points, but a majority of the surfaces of both blanks 105, 205 are in contact with and/or adhered to one another.

Referring to FIG. 2, the outer blank ply 105 comprises a first end panel 110 foldably connected to a first side panel 120 at a first transverse fold line 111, a second end panel 130 foldably connected to the first side panel 120 at a second transverse fold line 121, and a second side panel 140 foldably connected to the second end panel 130 at a third transverse fold line 131. Adhesive panels 150, 152 may be foldably connected to the first end panel 110 at a fourth transverse fold line 151.

The first end panel 110 is foldably connected to a first end top flap 114 and a first end bottom flap 118. The first side panel 120 is foldably connected to a first side top flap 124 and a first side bottom flap 128. The second end panel 130 is foldably connected to a second end top flap 134 and a second end bottom flap 138. The second side panel 140 is foldably connected to a second side top flap 144 and a second side bottom flap 148. The top flaps 114, 124, 134, 144 extend along a first or top marginal area of the outer blank 105, and may be foldably connected along a first longitudinally extending fold line 166. The bottom flaps 118, 128, 138, 148 extend along a second or bottom marginal area of the outer blank 105, and may be foldably connected along a second longitudinally extending fold line 162. The first and second longitudinal fold lines 166, 162 may be, for example, generally straight fold lines, or, the fold lines 166, 162 may be offset at one or more locations to account for, for example, blank thickness or other factors. When the carton 400 (FIG. 6) is erected, the top flaps 114, 124, 134, 144 close a top of the carton 400, and the bottom flaps 118, 128, 138, 148 close a bottom of the carton 400.

Figure 6:
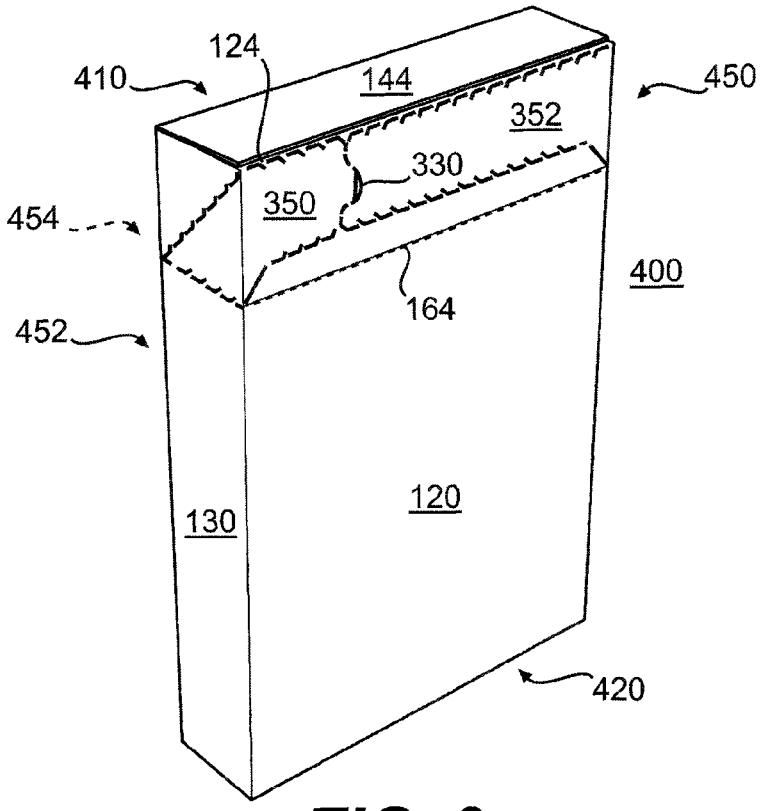
FIGS. 6 and 7 illustrate the multi-ply carton according to the first embodiment of the invention.

Longitudinally extending lines of disruption 310, 312, 314, 316 extend along the length of the blank 105. The lines of disruption 310, 312, 314, 316 in part define a bottom edge of the reclosable lid 450 in the carton 400 (FIG. 6). The longitudinal line 314 is a hinge or pivot line defining a bottom edge of a second side lid panel 142 in the second side panel 140. In the illustrated embodiment, the hinge line is a cut-crease line, although other lines of disruption such as crease lines, score lines, cut-space lines, etc., enabling pivoting thereabout may be used. The longitudinal line of disruption 312 is a breachable line of disruption defining a bottom edge of a second end lid panel 132 in the second end panel 130. The longitudinal line of disruption 310 is a hinge or pivot line defining a bottom edge of a first side lid panel 122 in the first side panel 120. The hinge line 310 may be, for example, a crease line, a cut-space line, a cut-crease line, a score line, and combinations thereof, etc. The longitudinal line 316 is a breachable line of disruption defining a bottom edge of a first end lid panel 112 in the first end panel 110. In the illustrated embodiment, the breachable lines of disruption 312, 316 are tear lines.

A tear pattern 300 of breachable lines of disruption is defined in the lid panels 112, 122, 132. The tear pattern 300 defines an opening feature for the reclosable lid 450. The tear pattern 300 comprises the tear lines 312, 316, an oblique tear line 320 in the second end lid panel 132, an oblique tear line 324 in the first end lid panel 112, and spaced longitudinally extending tear lines 304, 308 in the first side lid panel 122. The tear pattern 300 defines adjacent tear strips 350, 352, which may be separated by and accessible at a tear tab pattern 330.

Figure 3:
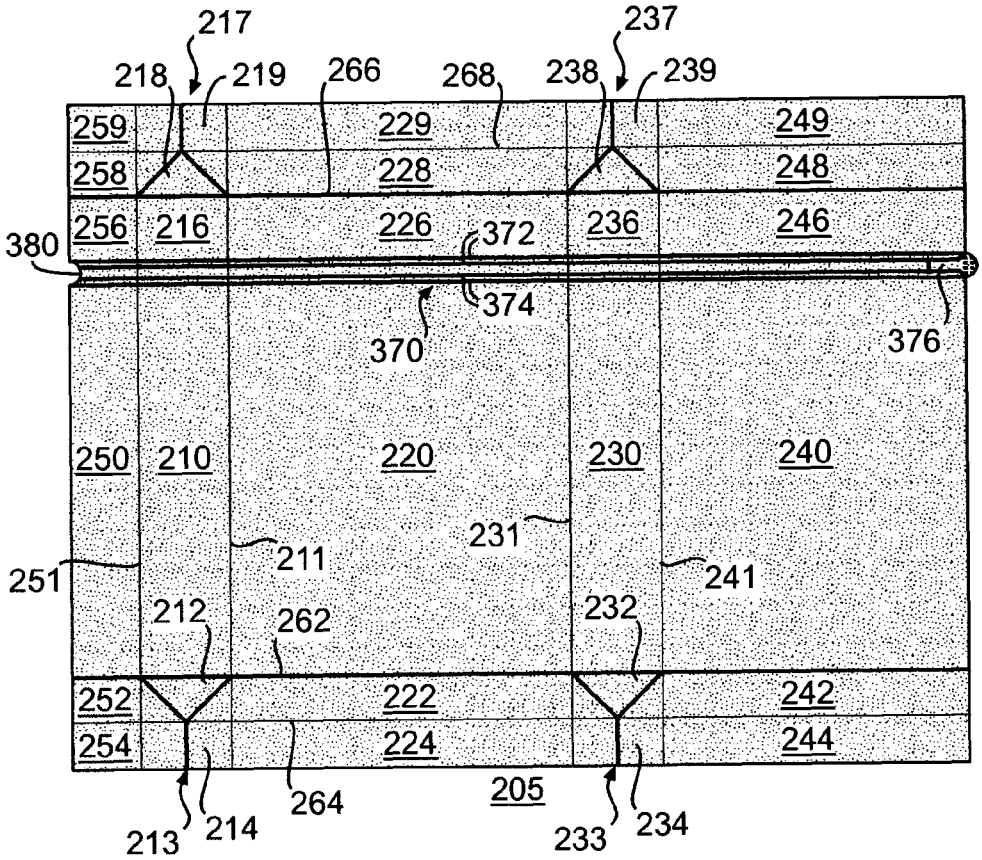
FIG. 3 is an isolated plan view of an inner blank ply of the multi-ply blank of FIG. 2.

FIG. 3 is an isolated plan view of the interior side of the inner ply or blank 205 of the multi-ply blank 8. The interior side of the inner blank 205 is adhered to the outer blank 105. In FIG. 3, the inner ply 205 is shown separate from the outer blank 105 in order to more clearly illustrate the lines of disruption formed in the inner blank 205.

The inner blank ply 205 comprises a first end panel 210 foldably connected to a first side panel 220 at a first transverse fold line 211, a second end panel 230 foldably connected to the first side panel 220 at a second transverse fold line 221, and a second side panel 240 foldably connected to the second end panel 230 at a third transverse fold line 231. Adhesive panels or flaps 250, 252, 254, 256, 258, 259 may be foldably connected at a fourth transversely extending fold line 251. The transverse fold lines 211, 221, 231, 241 in the inner blank 205 may be formed in the same step (e.g., at the disrupting station H shown in FIG. 1), for example, as the transverse fold lines 111, 121, 131, 141 in the outer blank 105. In accordance with the first embodiment, the method of production ensures that the panels 210, 220, 230, 240 of the inner blank 205 generally correspond to and align with the panels 110, 120, 130, 140, respectively, in the outer blank 105.

Longitudinally extending pairs of lines of disruption 372, 374 (e.g., tear lines) extend along the length of the blank 205 and define an elongated inner tear strip 370. The inner tear strip 370 can include, for example, a pull tab portion 376 at one end, with a corresponding cutout section 380 of the inner blank 205 being formed at the opposite end of the tear strip 370. The cutout section 380 in the inner blank 205 represents the area occupied by the pull tab 376 in a following inner blank 205 in a continuous production process (FIG. 1).

The inner tear strip 370 defines the bottom edge of a first end upper section 216 in the first end panel 210, a first side upper section 226 in the first side panel 220, a second end upper section 236 in the second end panel 230, a second side upper section 246 in the second side panel 240, and an adhesive upper section 256 in the adhesive panel 250. Top end flaps 258, 218, 228, 238, 248 are foldably connected to the panels 250, 210, 220, 230, 240, respectively, at a longitudinal fold line 266. A longitudinally extending fold line 268 extends along the length of the inner blank 205 and in part defines flaps or panels 219, 229, 239, 249, 259 in the flaps 218, 228, 238, 248, 258, respectively. The panels 218, 232 may include gable score patterns 217, 237, respectively, that facilitate closure of the top end of the inner blank 205. The flaps 218, 228, 238, 248, 258, 219, 229, 239, 249, 259 extend along a first or upper marginal area of the inner blank 205.

At a second or bottom marginal area of the inner blank 205, the first end panel 210 is foldably connected to a first end bottom flap 212. The first side panel 220 is foldably connected to a first side bottom flap 222. The second end panel 230 is foldably connected to a second end bottom flap 232. The second side panel 240 is foldably connected to a second side bottom flap 242. The bottom flaps 212, 222, 232, 242, 252 may be foldably connected along a longitudinally extending fold line 262. A longitudinally extending fold line 264 extends along the length of the inner blank 205 and in part defines panels or flaps 214, 224, 234, 244, 254 within the bottom flaps 212, 222, 232, 242, 252, respectively. The bottom panels 212, 232 may include gable score patterns 213, 233, respectively, that facilitate closure of the bottom end of the inner blank 205.

Figure 4A:
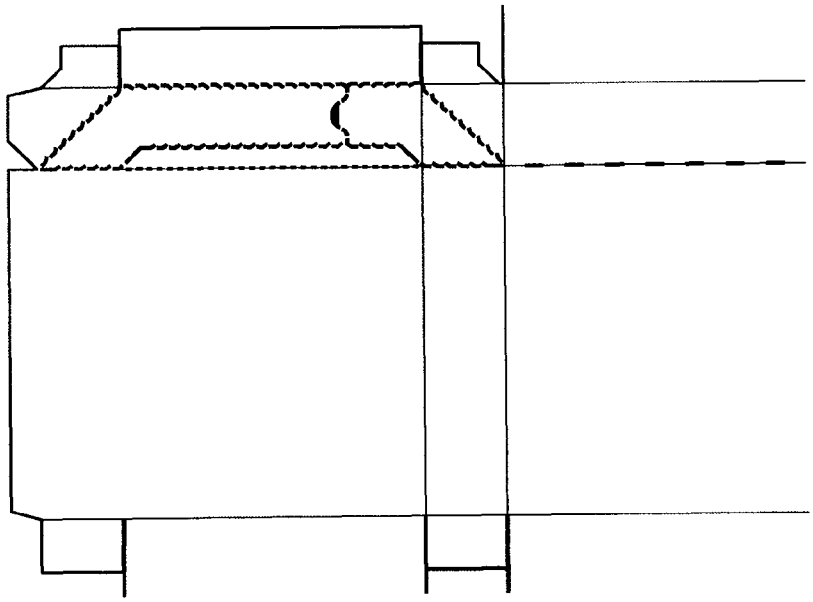
FIG. 4A illustrates a pattern of lines of disruption formed in a first material web by the production line illustrated in FIG. 1.

As discussed above with reference to FIGS. 1 and 2, the outer web A may be provided with repeating patterns of lines of disruption at the disrupting station F (e.g., to partially form outer blanks 105), and the inner web B may be provided with repeating lines of disruption at the disrupting station E (e.g., to partially form inner blanks 205). The combined webs A and B may thereafter be provided with additional lines of disruption at the disrupting station H. FIG. 4A illustrates the pattern of lines of disruption that is repeatedly formed in the web A at the station F according to one exemplary method of forming the blank 8. The pattern shown in FIG. 4A is repeated end-to-end continuously in the web A as the web is advanced through the continuous process production line.

Figure 4B:
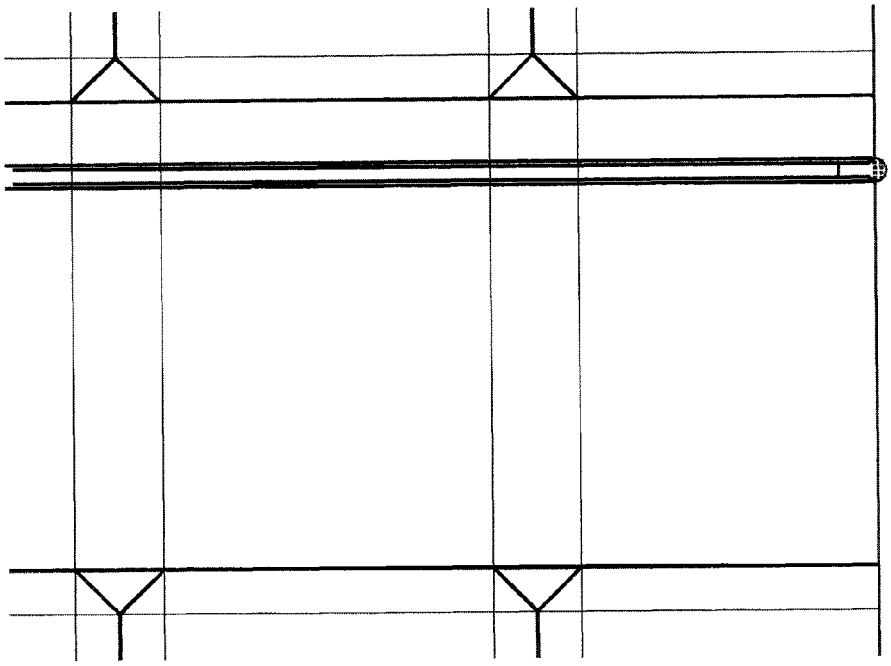
FIG. 4B illustrates a pattern of lines of disruption formed in a second material web by the production line illustrated in FIG. 1.

FIG. 4B illustrates the pattern of lines of disruption repeated in the inner web B as the web is advanced through the continuous process production line. The webs A and B are aligned in the machine direction so that the repeating patterns in FIGS. 4A and 4B ultimately have the orientation shown in FIG. 1 as the webs A, B enter the lamination station G. At the lamination station G, the inner web B can be laminated, joined or otherwise adhered to the interior side of the outer web A across essentially the entire overlapping surface of the area corresponding to the blanks 105, 205. Adhesion occurs in the area of the outer blank 105 between the fold line 162 and the longitudinally extending lines 314, 312, 310, 316. Referring to FIG. 3, the area of the inner blank 205 outside of the longitudinal lines 374 and 262 should remain unadhered to the outer blank 105.

Figure 4C:
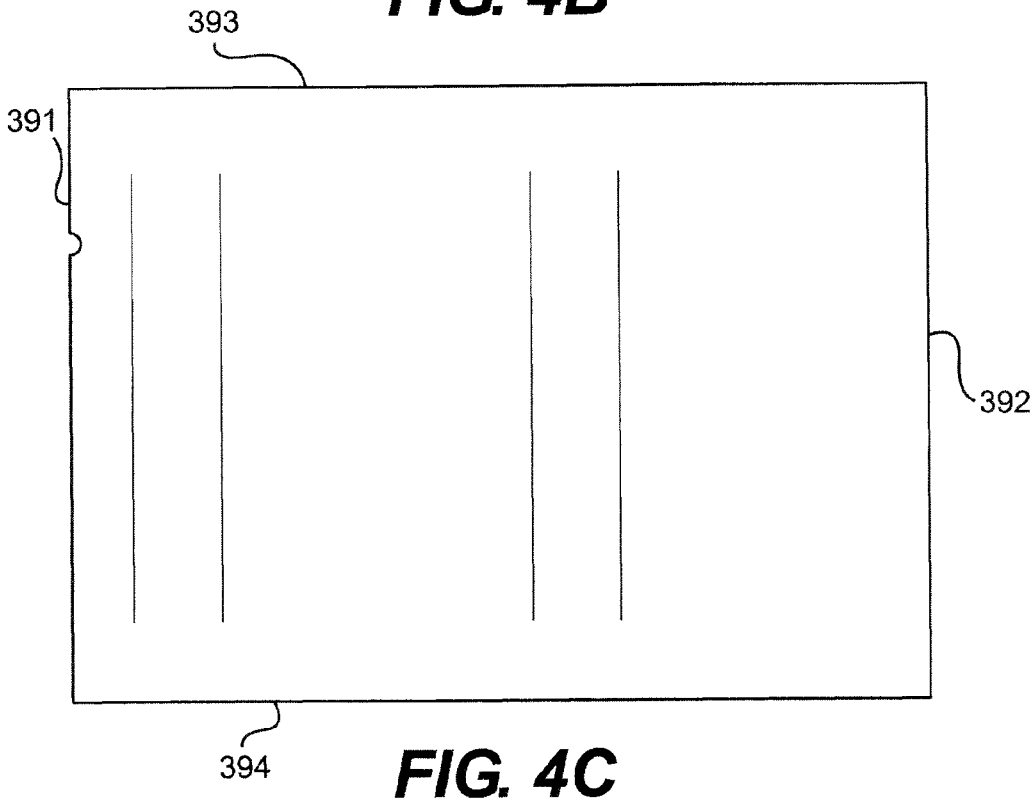
FIG. 4C illustrates a pattern of lines of disruption formed in a combined material web by the production line illustrated in FIG. 1.

After the webs A and B are adhered together at station G, the joined webs are repeatedly provided with the pattern of lines of disruption shown in FIG. 4C at the third disrupting station H. The combined webs A, B can be, for example, cut into individual blanks 8 at the station H by the transverse cuts 391, 392 illustrated in FIG. 4C. Longitudinal cuts 393, 394 may also be formed in the combined webs A, B to define upper and lower edges, respectively, of the blanks 8. The resultant blanks 8 then exit the station G as shown in FIG. 1. Scrap material removed from the joined webs A, B can be removed at this time.

An exemplary method of erecting the carton 400 from the multi-ply blank 8 will now be discussed with reference to FIGS. 5A-5C.

Figure 5A:
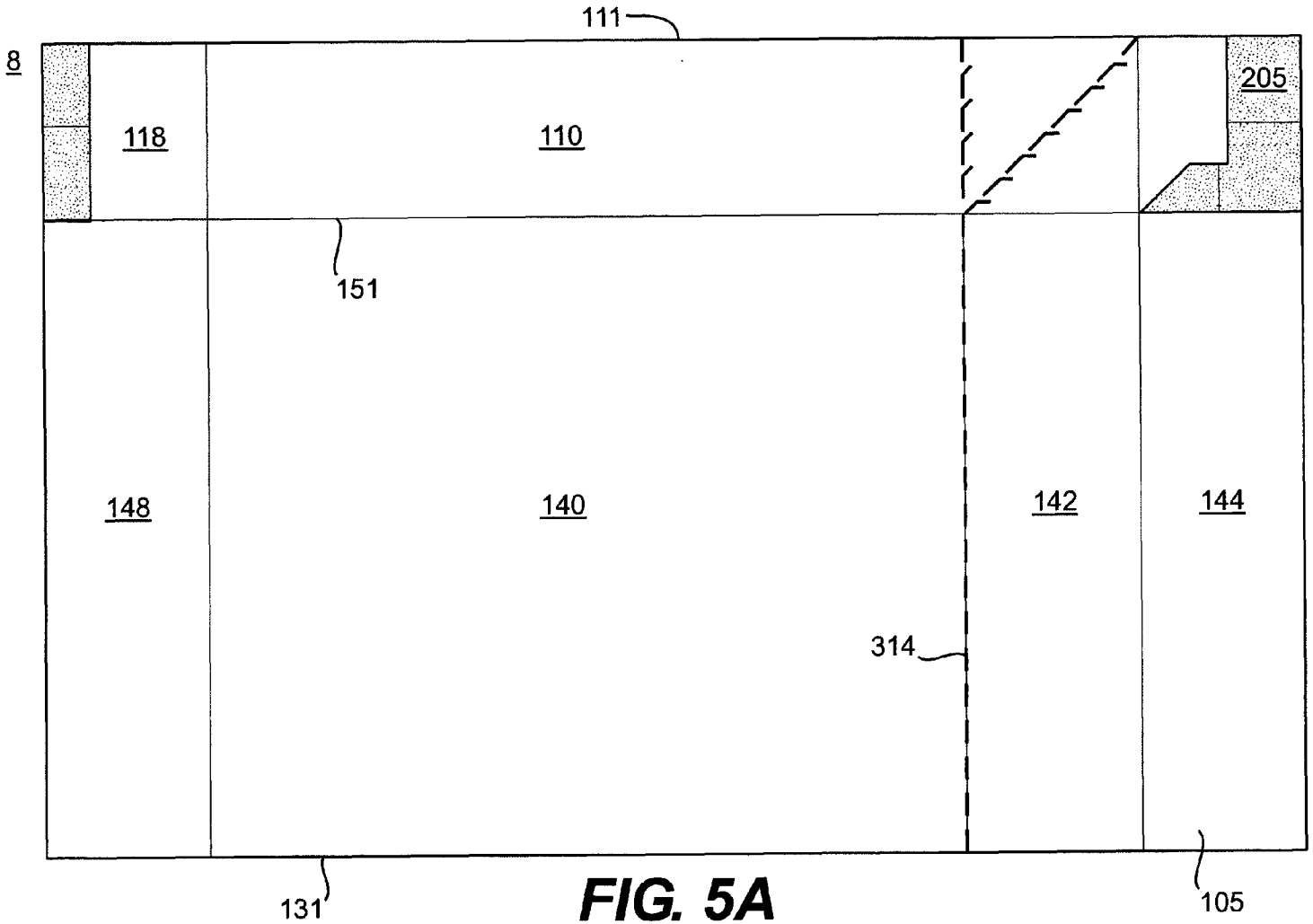
FIGS. 5A-5C illustrate erection steps for erecting the multi-ply blank illustrated in FIG. 2 into a multi-ply carton according to the first embodiment of the invention.

Referring to FIGS. 2, 3 and 5A, the carton 400 may be erected by applying glue, adhesive or other means to the adhesive panels 250, 252, 254, 256, 258, 259 of the inner blank 205 and folding the multi-ply blank 8 flat about the overlapping transverse fold lines 111, 211 and about the overlapping fold lines 131, 231 in the blanks 105, 205, respectively. The adhesive panels 250, 252, 254, 256, 258, 259 may therefore be adhered to the panels 240, 242, 244, 246, 248, 249, respectively, of the inner blank 205.

The adhesive panels 150, 152 of the outer blank 105 are adhered to the panels 140, 142, respectively, by, for example, glue, adhesives, or other means. The multi-ply blank 8 may then be "opened" to have the generally rectangular tubular shape shown in FIG. 5B.

Figure 5B:
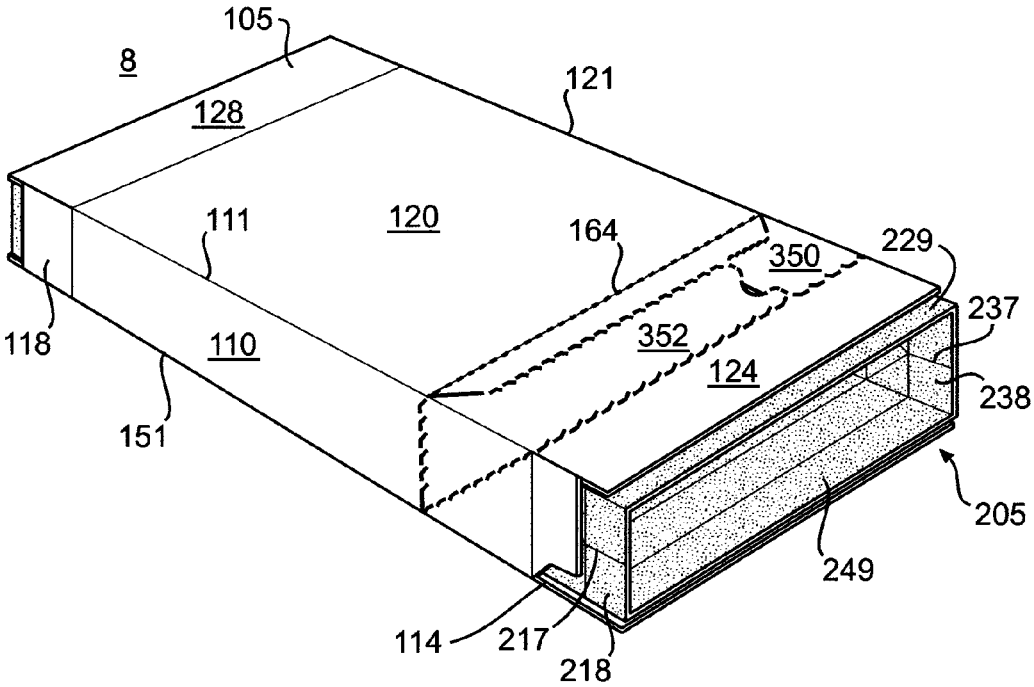

Referring to FIG. 5B, the top of the inner blank 205 is closed by sealing the top flaps or panels 218, 229, 238, 249 and the bottom of the blank 205 is closed by sealing the bottom flaps or panels 212, 224, 232, 244. The top flaps and the bottom flaps of the blank 205 can be sealed, for example, using conventional processes for sealing gabled carton blanks. In one such application, referring also to FIG. 3, the flaps 218, 238 are folded outwardly at the gabled sections 217, 237, respectively, and glued in a conventional manner to form a "fin seal." The flaps 229, 249 are adhered together. The top of the inner blank 205 is thereby sealed and/or otherwise closed. The bottom flaps 212, 224, 232, 244 can be adhered in a similar manner to seal or otherwise close the bottom of the inner blank 205. The gabled sections of the upper and lower sections of the blank 205 may also be folded inwardly and sealed.

The flaps 114, 124, 134, 144, 118, 128, 138, 148 (shown in FIG. 2) of the outer blank 105 can be folded back away from the inner blank 205 in order to facilitate closing and/or sealing of the top and bottom ends of the inner blank 205. Product may be inserted in the inner blank 205 at any time before sealing both ends of the inner blank 205. The closed ends of the inner blank 205 may be folded over to have generally flat profiles in order to allow closure of the ends of the outer blank 105. When the top and bottom ends of the inner blank 205 are adhered together, the inner blank may form a closed vessel or liner having, for example, liquid and/or gas tight properties, if desired.

Figure 5C:
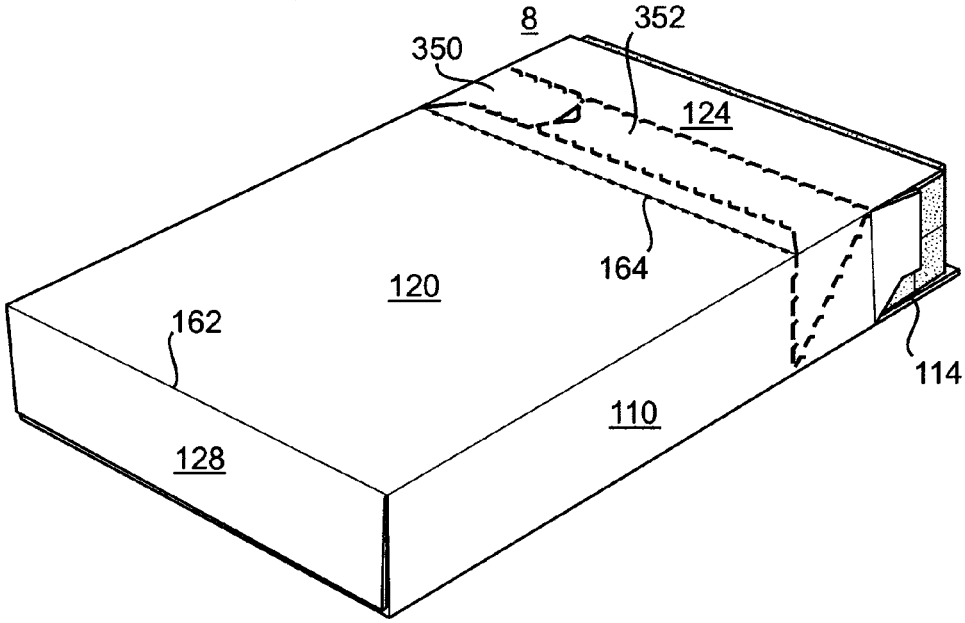

Referring to FIG. 5C, to close the bottom of the tubular carton form of the outer blank 105, the first and second end bottom flaps 118, 138 (shown in FIG. 2) are folded inwardly, followed by the second side bottom flap 148 (FIG. 2), then the first side bottom flap 128. The underside of the first side bottom flap 128 is adhered to the exterior side of the second side bottom flap 148. Portions of the first and second side bottom flaps 128, 148 may also be adhered to the first and second end bottom flaps 118, 138.

To close the top of the tubular carton form of the outer blank 105, the first and second end top flaps 114, 134 are folded inwardly, followed by the second side top flap 144, then the first side top flap 124. The underside of the first side top flap 124 is adhered to the exterior side of the second side top flap 144. Portions of the first and second side top flaps 124, 144 may also be adhered to the first and second end top flaps 114, 134.

Figure 7:
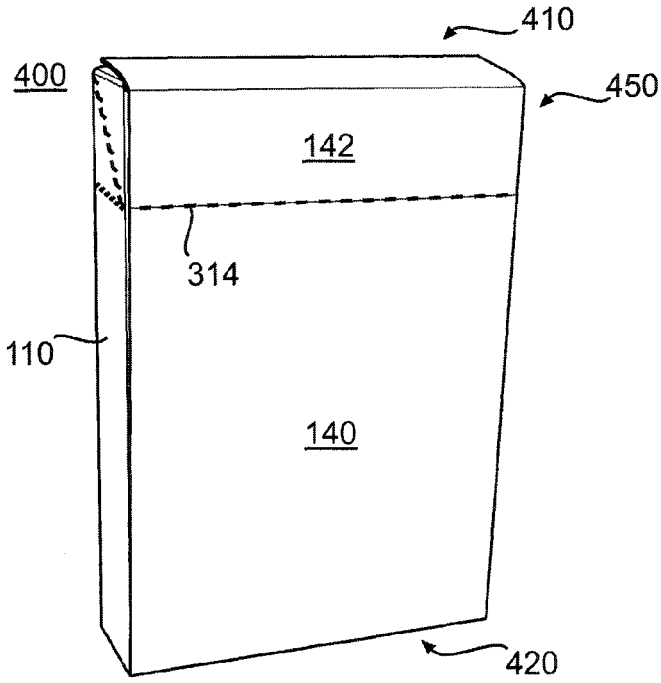

FIGS. 6 and 7 illustrate the erected carton 400 with the top and bottom ends of the tubular form closed. The erected carton 400 has a generally parallelepipedal form, with the outer blank 105 forming an outer ply or shell 452 of the carton, and the inner blank 205 forming an inner ply or vessel 454. The inner ply 454 may have the properties of a barrier seal vessel, a structural reinforcing member, or both. In FIG. 6, the inner liner vessel 454 is not visible and is therefore indicated by a dashed lead line. The bottom flaps 118, 128, 138, 148 of the outer blank 105 (FIG. 2) define a bottom panel 420, and the top flaps 114, 124, 134, 144 define a top panel of the carton 400. Referring also to FIG. 1, the panels and flaps disposed above the lines of disruption 310, 312, 314, 316 in the outer blank 105 define a reclosable lid 450 in an upper portion of the carton 400. As shown in FIG. 6, the outer tear strips 350, 352 provide access for opening the reclosable lid 450. FIG. 7 illustrates the back of the carton 400, including the hinge line 314 about which the lid 450 is pivotable.

Figure 8:
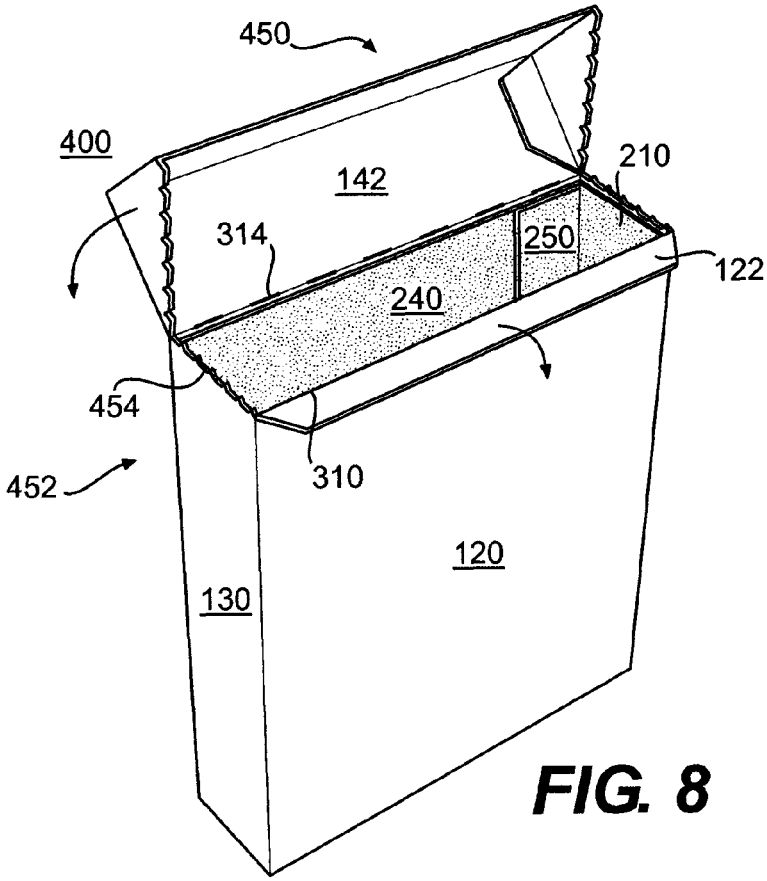
FIGS. 8 and 9 illustrate opening and reclosure of the reclosable lid of the first carton embodiment.
Figure 9:
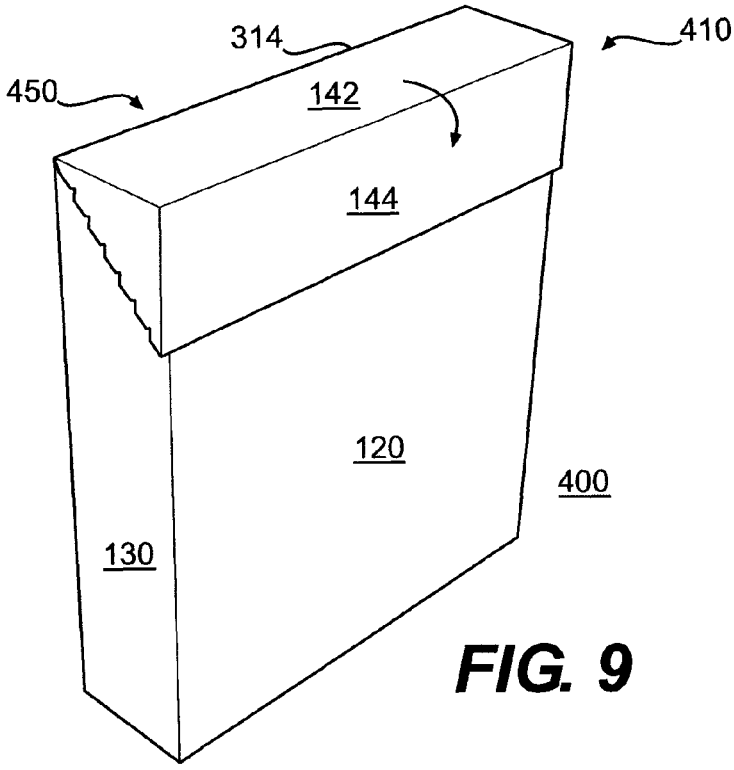

FIGS. 8 and 9 illustrate opening and reclosure of the carton 400. Referring to FIG. 8, and also to FIG. 7, the reclosable lid 450 can be opened by accessing the outer tear strips 350, 352 in the outer ply of the carton 400 at the tear tab pattern 330, and tearing the outer strips 350, 352 away from the carton. The reclosable lid 450 can then be pivoted back about the hinge line 314 in the second side panel 140 in the direction of the large curved arrow. A latch section 322 of the first side lid panel 122 (FIG. 2) remains after removal of the tear strips 350, 352. The latch section 322 is pivoted forward about the hinge line 310 in the direction of the small curved arrow so that it extends forward or even downwardly from the hinge line 310.

After the reclosable lid 450 formed in the outer ply of the multi-ply carton 400 is opened, the inner tear strip 370 (illustrated in FIG. 3) in the inner ply or liner vessel 454 can be removed and the sealed upper section of the inner blank 205 removed. The carton 400 is now opened as illustrated in FIG. 8. Referring also to FIG. 3, the portions of the inner blank ply 205 below the inner tear strip 370 remain within the outer carton ply. The contents of the inner blank ply 454 can now be dispensed or otherwise removed through the opened top end of the carton 400 as desired.

Referring to FIG. 9, the carton 400 is reclosed by pivoting the lid 450 about the hinge line 314 in the direction of the curved arrow. The forwardly projecting latch section 322 engages the interior surface of the lid 450 and securely retains the lid in its closed position. When the reclosable lid 450 is closed, the top panel 410 of the carton 400 faces forward as shown in FIG. 9.

According to one aspect of the present invention, the outer blank 105 can be constructed from materials such as, for example, paperboard, clay coated newsprint (CCN), solid unbleached sulfate (SUS) board, etc. The inner liner blank 205 may also be constructed of such materials, for example, and may additionally provided with a coating capable of sealing the contents of the carton 400 from moisture, infestation, and/or to render the contents of the carton insulated from the outside atmosphere. Once opened, the pivotable lid 450 of the outer ply of the carton 400 enables easy reclosure and opening of the carton for dispensing the carton contents. The latch section 322 may prevent the lid 450 from inadvertently opening, for example, when the carton 400 is tipped over or otherwise upset. The lid 450 pivots about the hinge line in the second side panel, which results in a relatively large surface area of the lid covering the open top of the carton 400 and also overlapping the side and end panels of the carton. Spillage from the open top of the carton 400 is thereby inhibited.

According to yet another aspect of the invention, the inner and outer carton blanks 105, 205 can be formed from material webs of relatively rigid paper or paper laminate materials that are capable of continuous processing on the same production line. The multi-ply blank 8 used to form the carton 400 is therefore quickly and easily manufactured. The inner liner blank 205 may also be constructed of fluid impervious materials having barrier properties such as, for example, polymers and polymer/paper laminates, etc. In general, heat sealable polymer-coated or polymer laminate materials, including multi-layer laminates such as paper/polymer/foil/polymer laminates, for example, capable of continuous processing in a continuous process production line such as illustrated in FIG. 1, can be used to form the inner liner blank 205. Examples of polymer materials include polyethylene, polypropylene, and copolymers.

According to another aspect of the invention, the height of the carton 400 is reduced after opening and closing. The carton contents are thereby stored in a carton that occupies less volume than the original carton. In the exemplary embodiment, the carton height is reduced approximately by the height of the panels 112, 122, 132, 142 (FIG. 1) when the carton 400 has been opened and reclosed. The height of the carton 400 can be reduced by at least 10% of the original carton height, or, in another embodiment, by at least 15% of the original carton height.

The interior and/or exterior sides of the inner and outer blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks, or laminated to or coated with one or more sheet-like materials at selected panels or panel sections. In one embodiment, a moisture barrier layer is applied to the interior surface of the inner blank.

In this specification, the terms "top," "side," "end," and "bottom" are used for clarity of description only, and are not intended to limit the scope of the invention except as specifically recited in the appended claims.

In accordance with the exemplary embodiment of the present invention, a fold or hinge line can be any substantially linear, although not necessarily straight, line of disruption in the blank that facilitates folding or hinged pivoting therealong during ordinary use and/or erection of a carton. More specifically, but not for the purpose of narrowing the scope of the present invention, fold lines include: score lines; crease lines; a cut or a series of cuts that extend partially into and/or completely through a blank along a desired line of weakness; and various combinations of these features.

For purposes of the description presented herein, the term "line of disruption" or "line of weakening" can be used to generally refer to a cut line, a score line, a tear line, a crease line, perforations, a fold line, or other disruptions formed in a blank, and overlapping and sequential combinations thereof. A "breachable" line of disruption as disclosed in the specification refers to a line of disruption that is intended to be breached or otherwise torn during ordinary use of a carton.

A tear line can be any breachable line of disruption that facilitates tearing therealong during ordinary use of the carton. Specifically, but not for the purpose of narrowing the scope of the present invention, tear lines include: a cut that extends partially into the material along the desired line of weakness, and/or a series of cuts that extend partially into and/or completely through the material along the desired line of weakness, or various combinations of these features.

The term "line" as used herein includes not only straight lines, but also other types of lines such as curved, curvilinear or angularly displaced lines.

The above embodiments may be described as having one or panels adhered together by glue. The term "glue" is intended to encompass all manner of adhesives commonly used to secure paperboard carton panels in place.

In the present specification, the terms "panel" and "flap" may generally indicate portions of blanks wholly or partially demarcated by lines of disruption. A "panel" or "flap" need not be flat or otherwise planar. A "panel" or "flap" can, for example, comprise a plurality of interconnected and/or overlapping generally flat or planar blank sections.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. A method of opening and closing a carton, comprising:

providing a carton formed from an inner blank that is adhered to an outer blank, wherein the outer blank comprises:

an outer first end panel;

an outer first side panel;

an outer second end panel opposite to the outer first end panel;

an outer second side panel opposite to the outer first side panel;

an outer bottom panel; and an outer top panel, wherein a reclosable lid comprises at least a portion of the outer top panel, at least a portion of the outer first end panel, at least a portion of the outer second end panel, and at least a portion of the outer first side panel, the reclosable lid being pivotably mounted at the outer second side panel, and wherein the inner blank comprises:

a plurality of inner panels forming a vessel within the outer blank, the plurality of inner panels comprising: an inner first end panel; an inner first side panel; an inner second end panel opposite to the inner first end panel; an inner second side panel opposite to the inner first side panel; an at least partially closed bottom end; and an at least partially closed top end;

opening the reclosable lid comprising removing at least one outer tear strip of the outer blank;

opening a top end of the vessel comprising removing an inner tear strip from the vessel; and closing the reclosable lid.

2. The method of claim 1, wherein:

the inner first end panel is adhered to the outer first end panel;

the inner first side panel is adhered to the outer first side panel;

the inner second end panel is adhered to the outer second end panel; and the inner second side panel is adhered to the outer second side panel.

3. The method of claim 2, wherein the inner blank comprises a plurality of top panels, the top panels including at least one gable score pattern.

4. The method of claim 1, wherein opening the reclosable lid further comprises pivoting the reclosable lid toward the outer second side panel.

5. The method of claim 1, wherein closing the reclosable lid comprises engaging a latch feature on the outer first side panel with the reclosable lid.

6. The method of claim 1, wherein closing the reclosable lid comprises engaging a latch feature on the outer first side panel with the reclosable lid.

7. The method of claim 1, wherein the carton is substantially parallelepipedal and the outer top panel comprises a plurality of outer top flaps and the bottom panel comprises a plurality of outer bottom flaps.

8. A carton formed from an inner blank and an outer blank, comprising:

the outer blank being formed into a substantially parallelepipedal form, the outer blank comprising:

an outer first end panel;

an outer first side panel;

an outer second end panel opposite to the outer first end panel;

an outer second side panel opposite to the outer first side panel;

an outer bottom panel; and an outer top panel, wherein a reclosable lid comprises at least a portion of the outer top panel, at least a portion of the outer first end panel, at least a portion of the outer second end panel, and at least a portion of the outer first side panel, the reclosable lid being pivotably mounted at the outer second side panel at a hinge line spaced from the outer top panel wherein the outer blank further comprises at least one outer tear strip defined by a plurality of breachable lines of disruption in at least the outer first end panel, the outer first side panel, and the outer second end panel, the at least one outer tear strip allowing the reclosable lid to be pivoted open upon removal of the at least one outer tear strip; and the inner blank being formed into a vessel disposed within the substantially parallelepipedal form, wherein the vessel comprises:

an inner first end panel adhered to the outer first end panel;

an inner first side panel adhered to the outer first side panel;

an inner second end panel adhered to the outer second end panel;

an inner second side panel adhered to the outer second side panel;

an at least partially closed bottom end; and an at least partially closed top end;

wherein the inner blank further comprises at least one inner tear strip defined by a plurality of breathable lines of disruption, the at least one inner tear strip allowing the liner vessel to be opened.

9. The carton of claim 8, wherein the top end of the inner blank comprises at least one gable score pattern.

10. The carton of claim 8, wherein a latch feature is defined in the outer first side panel.

11. The carton of claim 8, wherein the hinge line extends substantially across an entire width of the second side panel.

12. The carton of claim 8, wherein the carton is substantially parallelepipedal and the outer top panel comprises a plurality of outer top flaps and the bottom panel comprises a plurality of outer bottom flaps.

13. The carton of claim 8, wherein the inner blank comprises a plurality of top end flaps, each top end flap is foldably connected to a respective one of the inner first end panel, the inner first side panel, the inner second end panel, and the inner second side panel, the plurality of top end flaps cooperating to form the at least partially closed top end.

* * * * *